United States Patent [19]

Bauer et al.

[11] 4,342,642

[45] Aug. 3, 1982

[54] STEAM PYROLYSIS OF HYDROCARBONS

[75] Inventors: William V. Bauer, New York, N.Y.; Morgan C. Sze, Upper Montclair, N.J.

[73] Assignee: The Lummus Company, Bloomfield, N.J.

[21] Appl. No.: 185,153

[22] Filed: Sep. 8, 1980

Related U.S. Application Data

[63] Continuation of Ser. No. 910,436, May 30, 1978, abandoned.

[51] Int. Cl.[3] ..... C10G 9/14; C10G 9/36; B01J 19/24

[52] U.S. Cl. ..... 208/130; 208/132; 422/197

[58] Field of Search ..... 208/78, 130, 132; 122/356; 422/197, 202

[56] References Cited

U.S. PATENT DOCUMENTS

| | | | |
|---|---|---|---|
| 1,887,155 | 11/1932 | Harnsberger | 208/132 |
| 2,198,555 | 4/1940 | Wilson | 208/79 |
| 3,198,727 | 8/1965 | Lifland | 208/79 |
| 3,205,048 | 9/1965 | Elsner | 260/683 R |
| 3,857,680 | 12/1974 | Porta | 422/197 |

*Primary Examiner*—T. M. Tufariello

*Attorney, Agent, or Firm*—Elliot M. Olstein; Louis E. Marn

[57] ABSTRACT

A portion of a steam pyrolysis tubular coil, preferably the outlet portion, is provided with an insert to provide a radiation absorption surface within the tube. The insert is dimensioned to increase heat flux without adversely increasing pressure drop. A preferred insert has a central body and outwardly extending vanes in contact with the interior of the coil.

9 Claims, 2 Drawing Figures

FIG. 1
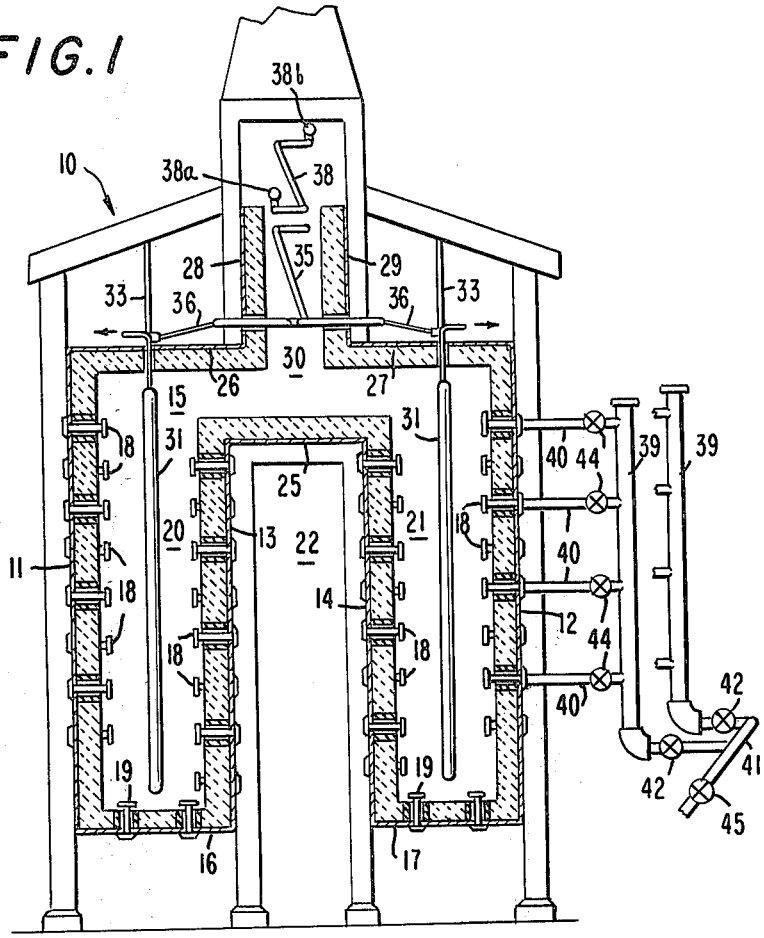
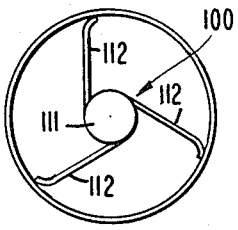
FIG. 2a
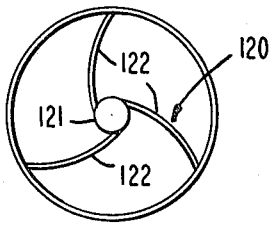
FIG. 2b
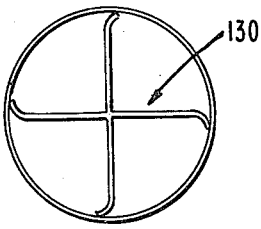
FIG. 2c
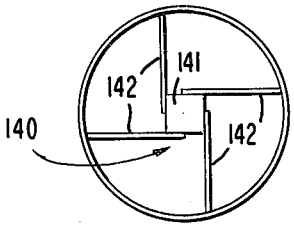
FIG. 2d

STEAM PYROLYSIS OF HYDROCARBONS

This is a continuation of application Ser. No. 910,436, filed May 30, 1978 now abandoned.

This invention relates to steam cracking (pyrolysis) of hydrocarbons and more particularly to a new and improved process and heater for effecting steam cracking of hydrocarbons.

In accordance with the present invention there is provided an improved process and heater for the steam cracking of hydrocarbons by providing the tubular processing coil with an interior insert to provide a radiation absorption surface within the processing coil. In accordance with the present invention, the use of such an insert increases the heat flux through the tube wall, can decrease the requisite residence time and also reduce the inside tube wall temperature, while maintaining the outside tube wall temperature unchanged.

The insert is designed and arranged in the tubular coil in a manner such as to provide a radiation absorption surface to increase heat flux without adversely increasing pressure drop. The insert is generally and preferably positioned at the outlet of the processing coil in that the most intense pyrolysis occurs at the coil outlet.

The tube insert is preferably in the form of a central portion spaced from the inner tube wall having outwardly extending arms or vanes which touch or almost touch the inner wall of the tube, in that such a configuration has been found to provide a heat absorption surface which produces a desired increase in heat flux without adversely increasing pressure drop. The insert should sub-divide the free internal cross-section of the tube into equal areas to provide for uniform gas flow. The insert should also preferably be centrally positioned (the central portion is most preferably axially aligned with the tube axis) so as to avoid poor distribution of gas flow through the free cross-section. In addition, the insert should be placed in the tube in a manner such as to prevent movement and vibration thereof which could lead to mechanical damage. The absorption of the insert can be increased, for example, by darkening the surface or providing an absorptive coating.

The insert is positioned in only a portion of the overall tubular coil for the heater (the overall coil may be comprised of one or more tubes), and is most preferably positioned at the coil outlet (at the outlet of the last tube of the coil). The insert generally has a length of at least 5 feet, and generally occupies from 15% to 100% of the length of the last tube. The cross-section of the insert, as hereinabove noted, is dimensioned to provide the desired increase in heat flux without adversely increasing the pressure drop in the portion of the tube having the insert; the increase in pressure drop resulting from the insert is generally no more than 5 psi, preferably no more than 3 psi. In general, the pressure drop increase is at least 0.3 psi and most generally at least 0.7 psi.

In accordance with the present invention, there is a considerable increase in the heat flux (BTU/hr.-ft.$^2$) in the portion of the tube having the insert. In general, the heat flux is increased in the order of at least 10%, preferably at least 20%, with such increase generally not being greater than about 50%. The increase in heat flux results from an improvement in direct convection from the tube to the cracking stream and from radiant heat transfer from the tube wall to the insert which transfers the heat by convection to the cracking stream.

In accordance with the present invention, as a result of the increase in heat flux, there is a reduction in the temperature of the inside wall of the portion of the tube with the insert. As a result, there is a decrease in coking of the tubes. It is noted that the increase in heat flux is achieved without increasing the overall surface area subject to coking in that the insert is at a much lower temperature and virtually free of coking tendency.

The hydrocarbon feedstocks may be any one of the wide variety of cracking feedstocks. The present invention is directed to the production of olefins and in particular ethylene. As illustrative feedstocks, there may be mentioned: ethane, propane, butane and mixtures thereof; naphtha; gas oil, etc. The product stream contains a wide variety of components and the product distribution, in part, is dependent on the feed selected.

The steam pyrolysis of hydrocarbons is effected at gas outlet temperatures in excess of 1400° F., and generally at gas outlet temperatures of from 1500° F. to 1800° F. The tube outlet pressure is generally a pressure of from 0 to 50 psig. The residence time is in the order of from 0.05 sec. to 2 sec. The pyrolysis is generally effected at steam to hydrocarbon ratios of from 0.2:1 to 1.5:1, by weight.

Although the hereinabove described overall conditions are similar to those generally used in the art, in an overall sense, by proceeding in accordance with the invention, for a given tube diameter, with other conditions also being fixed (outlet pressure; mass velocity, steam to hydrocarbon ratio, firing rate, etc.), there can be achieved a reduction in the overall residence time, i.e., the use of an insert reduces overall residence time. If desired, the overall coil length can be decreased.

The invention will be further described with respect to the accompanying drawings, wherein:

FIG. 1 is a simplified schematic representation of a pyrolysis furnace which can employ the present invention; and FIG. 2A, 2B, 2C and 2D are simplified schematic top views of a portion of a pyrolysis tube including the insert.

Referring to FIG. 1, there is provided a vertical tube type heater, supported on structural steel framework, generally indicated as 10, mounted piers and comprised of outer walls 11 and 12, inner walls 13 and 14, end walls 15 and floors 16 and 17. Outer walls 11 and 12 are substantially parallel to inner walls 13 and 14 with the height of outer walls 11 and 12 extending above the height of inner walls 13 and 14. Mounted in outer walls 11 and 12 and inner walls 13 and 14 are a plurality of vertical rows of high intensity radiant type burners, generally indicated as 18. The floors 16 and 17 extend between the outer walls 11 and 12, and inner walls 13 and 14, respectively. The floors 16 and 17 are provided with floor burners, generally indicated as 19 and are preferably of the flame type.

The outer wall 11, inner wall 13 and floor 16 together with end walls 15 form a radiant heating zone, generally indicated as 20, while outer wall 12, inner wall 14 and floor 17 together with end walls 15 form a second radiant heating zone, generally indicated as 21. End walls 15 are in the shape of an inverted U thereby forming an open area 11 permitting the access to the burners 18 mounted in the inner walls 13 and 14.

Horizontally positioned and mounted on inner walls 13 and 14 is inner roof 25. Horizontally positioned and extending inwardly from outer wall 11 is upper roof 26 mounted on outer wall 11 and end walls 15, while similarly positioned and mounted on outer wall 12 and end upper roofs 26 and 27 are upper walls 28 and 29 which form with the upper extending portions of end walls 15, a convection zone, generally indicated as 30. All of the walls, floors and roofs are provided with suitable refractory material.

In the radiant heating zones 20 and 21 there is provided a plurality of vertical tubes 31 suitably mounted from supporting structure 10 by hangers 33. The plurality of vertical tubes 31 are positioned intermediate the outer and inner walls 11 and 13, the outer and inner walls 12 and 14, respectively. The tubes are arranged for a plurality of passes to provide a process coil, and are provided with suitable return bends and outlet means.

Mounted within the convection zone 30 are horizontally disposed conduits, schematically illustrated and generally indicated as 35. The conduits 35 are in fluid communication with the tubes 31 through crossovers 36. Also positioned within the convection section 30 is a second section of horizontally disposed conduits generally indicated as 38. Inlet and outlet manifolds **38*a* and 38*b* are in fluid communication with the conduits 38**.

The burners 18 are supplied with the fuel through lines 40 from a plurality of manifolds 39. The fuel is introduced into manifolds 39 through a manifold 41 under control of valves 42. The flow of fuel to burners 18 may be varied in vertical rows depending on the desired severity of firing of the tubes 31. Individual burners may be further adjusted by hand valves 44 in lines 40 with the total flow of fuel to the heater being controlled by valve 45. It is understood that the burners mounted in outer walls 11 and 12 and inner walls 13 and 14 have similar manifold means.

It is understood that the number of passes of the fluid through the vertical tubes within the radiant heating zone may be varied depending on the feed, product specification, etc., i.e., the tubes represent a multiplicity of vertical coils vertically disposed within the radiant heating zones.

The basic heater is described in U.S. Pat. No. 3,274,987.

A portion of the pyrolysis tubes 31, in particular, the outlet tube of each pass, includes an interior insert to provide a radiation absorption surface within the outlet tube of the coil. As shown in FIG. **2*a*, the insert 100 is in the form of a three-vaned spider, having a central body portion 111 and vanes 112 which are curved at the tips thereof; i.e., at the portion touching the tube wall. The spider is force fitted into the tube to provide the desired positioning restraint and divides the interior tube portion into three passages. The central portion 111** of the spider is positioned along the tube axis.

FIG. **2*b* illustrates an insert 120 having a central body portion 121 and three outwardly extending curved vanes 122** which divide the tube interior into three separate passages.

FIG. **2*c* illustrates an insert 130** in the form of a four vaned spider, outwardly curved at the ends thereof to divide the tube interior into four passages.

FIG. **2*d* illustrates an insert 140 having a central body portion 141 and four outwardly extending vanes 142** which divide the tube interior into four separate passages.

Although the invention has been described with reference to a specific heater structure, it is to be understood that the invention is not limited to such structure.

The invention will be further described with respect to the following example; however, the scope of the invention is not to be limited thereby.

EXAMPLE

The tube insert is a three vaned spider as illustrated in FIG. **2*a***. The vanes are $\frac{1}{8}$" thick and there is only a slight decrease in free-flow cross-section and a slight increase in pressure drop.

| BASIS: | | |
|---|---|---|
| Tube Size: | | 6" I.D. × $\frac{1}{4}$" w.t. |
| Throughput: | Hydrocarbons | 8,800 Lb/H |
| | Steam | 4,400 Lb/H |
| | Total | 13,200 Lb/H |
| Outlet pressure | 22 PSIA | |
| Outer tube wall t: | 1080° C.(1976° F.) | |
| Gas temperatures | | |
| Inlet to last tube: | 825° C.(1517° F.) | |
| Outlet | 850° C.(1562° F.) | |
| Conversion or cracking: | 75% at inlet to last tube | |
| (% of coil conversion) | 100% at outlet | |
| Heat of cracking | 28,000 BTU/Lb. Mole HC product | |
| Calculated Duty, last tube (sens. + cracking) | 1,980,000 BTU/H | |

| RESULTS: | Without Insert | With Insert |
|---|---|---|
| Tube cross-sect. area | 0.196 $ft^2$ | 0.188 $ft^2$ |
| Gas velocity, ave. | 696 ft/sec | 726 ft/sec |
| Re (Reynolds number) | $4.24 \times 10^5$ | $2.22 \times 10^5$ |
| h, BTU/H-$ft^2$-°F./in | 96 | 115 |
| Wall temp., inside | 1926° F. | 1907° F. |
| Heat flux (Tube I.D.) | | |
| Convec. tube-gas, BTU/H-$ft^2$ | 37,000 | 42,300 |
| Radiant to gas BTU/H-$ft^2$ | 1,200 | 700 |
| Radiant to insert BTU/H-$ft^2$ | — | 8.000 |
| Total | 38,200 | 51,000 |
| Tube length req'd. | 33 ft. | 24.7 ft. |
| Resid. time, sec. | 0.0475 | 0.034 |
| Pressure drop | 1.35 PSI | 2.44 PSI |

The use of the insert increases heat flux through the tube wall by about 33.3%. In addition, there is a decrease in the temperature of the inner tube wall, without the insert temperature reaching too high a value (insert temperature is 1610° F.). In addition, there is only a slight increase in pressure drop. The present invention is particularly advantageous in that the heat flux is increased which permits a reduction in residence time to increase selectivity. In addition, such a result is achieved without increasing tube wall temperature (in fact tube wall temperatures are lower) which reduces coking tendency. It is to be understood that in the alternative, for the same residence time, it is possible by proceeding in accordance with invention to achieve higher gas outlet temperatures.

Numerous modifications and variations of the present invention are possible in light of the above teachings and, therefore, within the scope of the appended claims the invention may be practised otherwise than as particularly described.

We claim:

1. A pyrolysis heater for the pyrolysis of hydrocarbons, comprising:

a radiant heating chamber; at least one tubular processing coil including an inlet and outlet for processing fluid in said heating chamber; a plurality of radiant burners for heating the at least one tubular processing coil, and said at least one processing coil including in at least a portion thereof an insert to provide a radiation absorption surface within the coil, said coil interior including only said insert, said insert comprising a central portion having radially extending vanes dividing all of the interior flow cross-section of the coil in said portion into separate continuous longitudinal flow passages between the insert and interior wall of the coil, said longitudinal flow passages providing for unimpeded flow, said insert being dimensioned to increase heat flux in said portion by at least 10 percent and to limit pressure drop increase in said portion to no greater than 5 psi.

2. The heater of claim 1 wherein the insert is positioned at the outlet of the coil.

3. The heater of claim 2 wherein the central portion of the insert is positioned at the coil axis.

4. The heater of claim 3 wherein said vanes provide said flow passages with essentially equal areas to provide for uniform gas flow.

5. The heater of claim 4 wherein the insert is dimensioned to limit pressure drop increase to no greater than 3 psi.

6. The heater of claim 5 wherein the insert is dimensioned to increase heat flux in said portion by at least 20%.

7. The heater of claim 6 wherein the coil contains at least two tubes, said insert having a length which is from 15% to 100% of the length of the last tube of the coil.

8. A process for the pyrolysis of a hydrocarbon, comprising:

passing steam in a hydrocarbon through a tubular processing coil in a radiant heating chamber to effect pyrolysis thereof at an outlet temperature of from 1500° F. to 1800° F. and a residence time of from 0.5 to 2 seconds, said steam and hydrocarbon in the outlet portion of said tubular coil being passed between an insert and the interior wall of the coil in separate continuous longitudinal unimpeded flow passages, said coil interior including only said insert, said insert comprising a central portion having radially extending vanes dividing all of the interior flow cross-section in said outlet portion into said flow passages, said insert providing a radiation absorption surface to increase heat flux, said insert being positioned in the outlet portion to increase heat flux by at least 10 percent and limit pressure drop increase to no greater than 5 psi.

9. The process of claim 8 wherein said hydrocarbon feed and steam are passed through said longitudinal flow passages in a uniform gas flow.

* * * * *